US005476249A

United States Patent [19]

Clement

[11] Patent Number: 5,476,249

[45] Date of Patent: Dec. 19, 1995

[54] LADLE FOR THE FILTRATION OF LIQUID METAL OVER A FILTER MEDIUM WITH IMPROVED HEATING

[75] Inventor: Guillaume Clement, Meylan, France

[73] Assignees: Aluminum Pechiney; Pechiney Rhenalu, both of Courbevoie, France

[21] Appl. No.: 329,871

[22] Filed: Oct. 27, 1994

[51] Int. Cl.[6] ..... C22B 9/02

[52] U.S. Cl. ..... 266/229; 266/242; 266/275

[58] Field of Search ..... 266/242, 229, 266/227, 275

[56] References Cited

U.S. PATENT DOCUMENTS

| | | | |
|---|---|---|---|
| 3,724,447 | 4/1973 | Parkhill et al. | 266/242 |
| 3,917,242 | 11/1975 | Bass et al. | 266/229 |
| 4,844,425 | 7/1989 | Piras et al. | 266/229 |

FOREIGN PATENT DOCUMENTS

| | | |
|---|---|---|
| 291580 | 11/1988 | European Pat. Off. . |
| 490371 | 6/1992 | European Pat. Off. . |
| 3151434 | 7/1982 | Germany . |
| 8813131 | 12/1988 | Germany . |

*Primary Examiner*—Scott Kastler

*Attorney, Agent, or Firm*—Dennison, Meserole, Pollack & Scheiner

[57] ABSTRACT

Ladle for the filtration of a liquid metal such as aluminum, magnesium, and their alloys over a filter medium of the gravel bed type. The ladle comprises a chamber in which the filter medium rests on a supporting grid, an inlet for supplying liquid metal to the chamber and an outlet for removing liquid metal from the chamber. The ladle includes first and second heaters for heating the liquid metal, the first heater being located outside the filter medium and the second heater being an electrical immersion heater which is located in the inlet or outlet and adjacent the filter medium. The second heater is arranged for immersion in liquid metal flowing through the inlet or the outlet.

11 Claims, 1 Drawing Sheet

LADLE FOR THE FILTRATION OF LIQUID METAL OVER A FILTER MEDIUM WITH IMPROVED HEATING

FIELD OF THE INVENTION

The invention relates to a ladle for the filtration of liquid metal, in particular aluminum or its alloys, but also magnesium or its alloys, over a filter medium (in particular a bed of alumina gravel), said ladle having its performance improved by a special heater.

DESCRIPTION OF THE RELATED ART

It is known to be necessary to filter liquid metals such as aluminium or its alloys before casting and that this filtration may be carried out over a bed generally of alumina gravel.

The gravel filter bed generally comprises a filtration layer proper which is sufficiently thick and is enclosed between two thinner holding layers consisting of coarser gravels. The bed is contained in a ladle, the liquid metal is supplied at the top and is removed at the bottom after having been filtered. The bed normally rests on a grid so as to leave a vacuum at the bottom of the ladle.

The filter bed may be heated up prior to filtration by conveying the bed into an oven before positioning it in the ladle. This heating up, as well as the maintenance of the bed at a temperature for periods of stoppage of filtration when the bed remains impregnated with liquid metal can also be carried out by means of burners located above the bed and/or by heating through the walls of the ladle, for example using resistors immersed in or located at the exterior of the walls so the resistors are not in contact with the bed or with the filtering liquid metal.

Professionals are generally prevented from introducing heaters into the filter bed so as not to disturb the flow of liquid metal there (risk of preferential passages) during filtration which would impair the quality of filtration.

Such methods of heating by radiation and/or conduction lead to excessive periods for heating up the bed and to temperature gradients which are also too high both in the preheated bed prior to the introduction of the liquid metal (including after long heating periods), and in the bed filled with liquid metal during periods of maintenance of temperature corresponding to stoppages of filtration. They are, for example, at least 100° C. and can reach almost 200° C. between the coldest and hottest points, even after several days of preheating, and at least about 50° C. after the liquid metal has been maintained at temperature for more than 6 h.

These gradients give rise to problems. For example, the lowest temperature of the bed should be higher than a limit value below which there is a risk that the liquid metal will coagulate during the first impregnation of the bed, that the filter bed will be poorly impregnated or the precipitation of intermetallic compounds will be caused, all this possibly leading to a blockage of the filter and to a loss in the quality of the cast metal; but at the same time the highest temperature should not exceed a limit value with the risk of causing significant oxidation of the liquid metal leading to the harmful formation of sullage and thus to pollution and degradation of the cast metal.

Thus, the Applicants have sought a method of overcoming these drawbacks without excessively increasing the installed heating power and/or the duration of heating while constantly controlling the temperature of the cast metal. In particular, they have attempted to reduce or eliminate the temperature gradient between the coldest point and the hottest point (for example between the bottom and the top) during the preheating period (prior to impregnation), but particularly for the period during which the bed impregnated with liquid metal is maintained at temperature (during stoppages of filtration).

They also attempted to improve the quality of the filtered metal, in particular after a stoppage period, by reducing the quantity of sullage formed during the period of maintenance at temperature.

SUMMARY OF THE INVENTION

The invention is a ladle for the filtration of liquid metal over a filter medium comprising a chamber within which there is located said filter medium resting on a supporting grid at its lower portion, a supply means supplying the liquid metal to be filtered into said filter medium, a means for removing the filtered liquid metal, a first heater located outside said medium, characterised in that it comprises a second heater located in at least one of the means for the supply or removal of liquid metal in the vicinity of the filter medium.

The invention applies to all filter media and applies in particular to ladles of which the filter medium is a filter bed based on gravel generally of alumina which are particularly difficult to heat correctly but also to the ladles of which the filter medium is a slab of ceramic foam (known by the name of CFF, ceramic foam filter) which have the same types of problems.

The supply and removal means are conventional means for the passage or circulation of liquid metal and typically comprise conduits, spouts, chambers . . . The heaters, or heating devices, are generally of the electric resistor type.

The first device may be a conventional device, as seen above, located outside the filter medium and the liquid metal. It can comprise, in particular, electric resistors immersed in the walls of the chamber or located at the point where they make contact with the exterior. However, it can preferably comprise resistors located in the lid of the ladle or preferably resistors (for example of the thermistor type) located in the vicinity of filter medium so that they are immersed when the ladle is filled with liquid metal. It is therefore situated in the upper portion of the ladle. These last devices may advantageously be completed and reinforced with means which cause said resistors to come into contact with an air stream which will then traverse and heat the filter medium before impregnation with the liquid metal; after passage through the filter medium, this heated air stream could be preheated again in an auxiliary heater and could be recycled in contact with said resistors; this complementary reinforcing device allows the period for heating up the medium and its thermal gradient to be reduced.

The supporting grid on which the filter medium rests is generally installed in the chamber so as to leave a free zone in the bottom of the ladle beneath the filter medium for the circulation of the liquid metal.

With regard to the second heater according to the invention, it is therefore also installed outside the filter medium and is immersed in the liquid metal after the liquid metal has been introduced into the ladle; it typically has a reduced bulk.

Said second device, like said resistors located in the vicinity of the filter medium of the first device, is located in a means for the passage of the liquid metal and is located as close as possible to the filter medium so as to improve the yield and the efficiency of heating; it is therefore preferable to install it so that it is not separated from the filter medium by a screen, for example by a partition or any insulating separating means, etc. It is very advantageous to install it in the means for supplying the liquid metal to be filtered, obviously in the immediate vicinity of the filter medium, allowing the temperature of the liquid metal to be monitored in a very precise and variable manner when it penetrates the medium. The first device is therefore located on the discharge side of the filtered liquid metal and allows heating to be distributed better between the two devices but in particular allows the discharge of said filtered liquid metal to be monitored better and allows better quality casting while avoiding waste.

Said second heater advantageously has reduced dimensions to avoid modification of existing ladles and to avoid increasing the spinning of liquid metal in the ladle. It is particularly advantageous to use at least one immersion heater comprising a heating portion which can be immersed in the liquid metal and has a small diameter, typically smaller than 40 mm and preferably smaller than 30 mm. This heating portion generally comprises an electric resistor immersed in a refractory substance which is an electric insulator and a good conductor of heat, the assembly being contained in a sheath which is a good conductor of heat, preferably of sintered ceramic to improve resistance to the liquid metal, for example of alumina, zirconia, alon, sialon, mixed oxynitride of Al and Mg, nitrides, etc.

The heating portion is lengthened at the exterior of the ladle by an extender serving for handling and for the electrical connections. Even with a small diameter heating portion, the dissipated power can be significant, allowing the performance of the ladle to be improved. It is normally higher than 5 kW/m of heating portion or preferably higher than 10 kW/m and can even attain and exceed 20 kW/m; it is surprising to note that, even in these conditions with a high energy flow, overheating of the liquid metal with aggravated risks of oxidation is not observed.

The filtering ladle according to the invention is generally large in size and serves to treat mainly aluminium or its alloys but also magnesium or its alloys.

When the filter medium is a bed of alumina gravel, it comprises a filter bed proper having a sufficiently fine grain size to carry out the desired filtration between two confining beds of greater grain size, everything resting on the supporting grid.

The medium can be supplied with liquid metal through the top by means of supply conduits, the filtered metal being removed from the bottom. However, the ladle according to the invention is particularly well suited to supply through the bottom with circulation of the liquid metal from bottom to top, a heating device thus being advantageously immersed toward the bottom of the ladle beneath the supporting grid in the immediate vicinity of the filter medium in the liquid metal entering the filter medium, the other heating device being located in the top portion of the ladle at the filtered metal outlet. This method of flow of the piston type allows the impregnation of the filter medium by the liquid metal to be improved when it is put into operation but also allows the evenness of filtration to be improved owing to the fact that the particles to be filtered tend to rest in the filter by natural decantation.

BRIEF DESCRIPTION OF THE DRAWING

The drawing Figure is a schematic cross-sectional diagram of a filtering ladle according to the invention.

DESCRIPTION OF THE PREFERRED EMBODIMENTS

Figure 1:
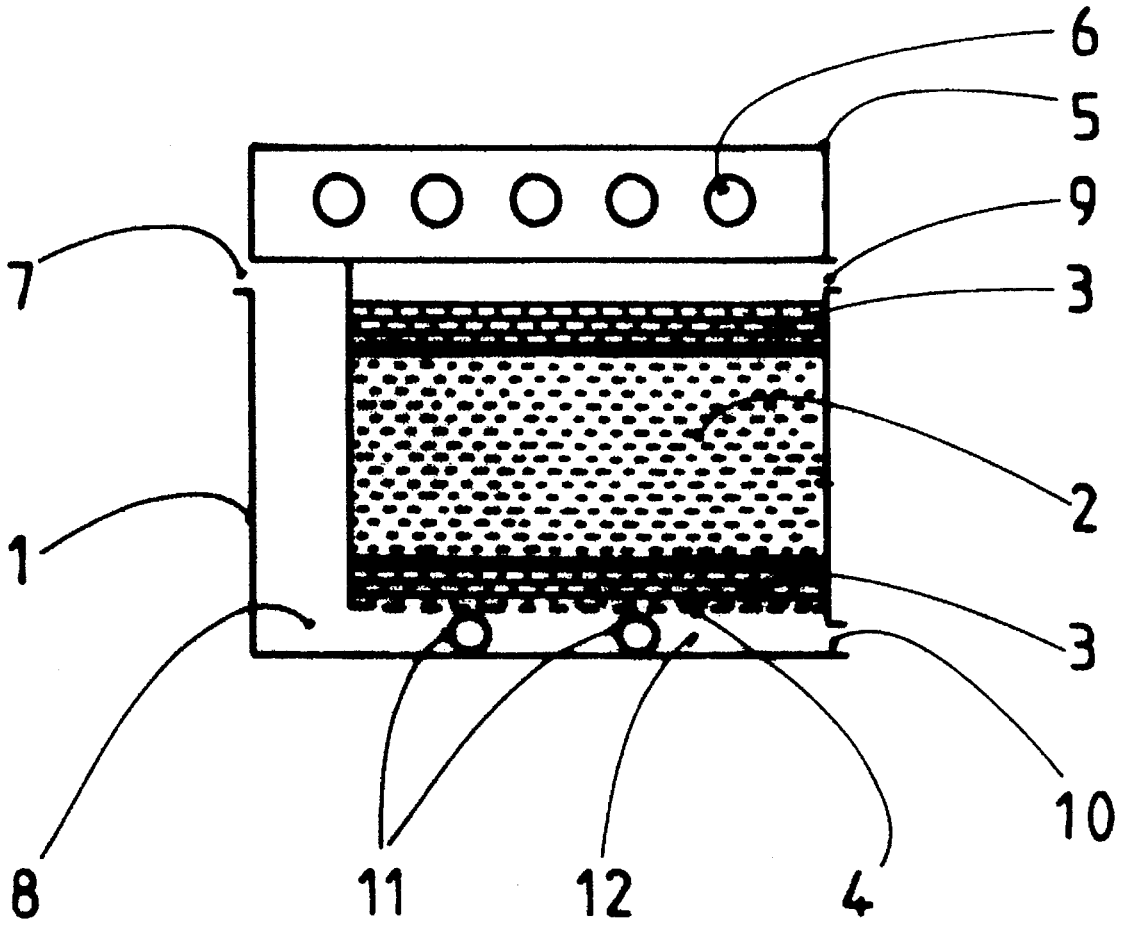

Reference numeral 1 designates the chamber of the ladle, 2 the gravel filter bed held between two layers 3 of coarser gravels, everything resting on a grid 4 leaving a space 12 which separates it from the bottom of the chamber and through which the liquid metal passes. The bed is topped by a first heater 5, for example resistors 6 which can be located in the lid of the ladle, which is intended to preheat the filter bed 2, 3 before introduction of the liquid metal or to maintain said bed and its charge of liquid metal at temperature during stoppages in filtration.

A different type of first device could be used (not shown). It involves heating the bed by conduction and radiation through the walls of the chamber, for example by means of resistors immersed in said walls or located outside said walls.

The second heater is represented by two immersion heaters 11 located in the space 12 beneath the supporting grid 4 of the filter bed 2, 3.

According to a preferred embodiment of the invention, the liquid metal to be filtered arrives at 7, is conveyed beneath the filter bed by means of the conduit 8, is filtered from bottom to top and issues in a purified form at 9. Filtration from top to bottom can also be carried out, the immersion heaters in this case being located in the liquid metal in the vicinity of the top of the filter bed, but can also rest beneath the grid downstream of the bed.

To improve the preheating of the filter bed, as mentioned, an air stream can be brought into contact with the resistors 6, the airstream being introduced into the chamber through the orifice 9, being thus reheated, then traversing the filter bed 2, 3 and issuing through the orifice 10 provided for this purpose. The result can be further improved by recycling the air issuing from 10, by preheating it in an auxiliary heater (not shown) and by reintroducing it into the chamber as mentioned above.

Thus, the ladle according to the invention which still comprises at least one heating means immersed in the liquid metal, preferably located in the supply of metal to be filtered, as seen, allows the filter medium to be preheated not only by means of a first heater 5, 6 but also by means of a second heater located upstream or downstream of the filter medium. It is therefore possible not to use the device for reinforcement by the circulation of air. The thermal gradient in the not yet impregnated medium is thus diminished and the duration of heating reduced.

It also allows, during the phase of impregnation of the filter medium by the liquid metal and owing to the heating device located on the metal supply side, variation of the temperature of the entering metal as it penetrates the medium, so as to eliminate the effects of the thermal gradients possibly remaining in the medium after heating; a metal charge with a uniform temperature is thus obtained. It also allows the temperature of the metal leaving the impregnation or filtration phase to be controlled very precisely and allows any problem and wastage during casting to be avoided, owing to the heater located downstream.

However, it mainly allows the temperature gradient in the metal charge to be eliminated virtually completely while reducing the heating share contributed by the first device 5, 6 during the phases of maintenance at temperature when the liquid metal bathes both the filter medium and the second heater. This reduction in the heating share leads to a spectacular decrease in the superficial oxidation of the metal at rest and therefore in its pollution by sullage which would impair the quality of castings whereas the disappearance of the temperature gradient eliminates the problems of casting linked with excessively high metal temperatures.

Thus, the invention shows, in addition to an advantage during preheating, in particular an advantage during the transitory regimes of operation of the filter (impregnation, restart after a stoppage) while generally obtaining very good evenness in the temperature of the filtered liquid metal; the quality of the cast metal is therefore improved.

It also allows the temperatures for the admission and discharge of liquid metal into and from the filter to be controlled very precisely, whether during the impregnation phase, the filtration operation or between two filtration operations, leading to a very good quality of cast metal and to a simplification and improvement in the uniformity of the casting operations.

What is claimed is:

1. Ladle for the filtration of liquid metal, comprising:

a) a chamber comprising a supporting grid at a lower portion thereof, and a filter medium resting on the supporting grid;

b) an inlet means for supplying liquid metal to the chamber;

c) an outlet means for removing liquid metal from the chamber;

d) a first heating means located outside of the filter medium, for heating the liquid metal; and e) a second heating means which is an electrical immersion heater for heating the liquid metal, located in said inlet means or said outlet means, and adjacent the filter medium, said second heating means being arranged for immersion in liquid metal contained in the means in which said second heating means is located.

2. Ladle for the filtration of a liquid metal selected from the group consisting of aluminum, aluminum alloys, magnesium and magnesium alloys, comprising:

a) a chamber comprising a supporting grid at a lower portion thereof, and a filter medium resting on the supporting grid;

b) an inlet means for supplying liquid metal to the chamber;

c) an outlet means for removing liquid metal from the chamber;

d) a first heating means located outside of the filter medium, for heating the liquid metal; and e) a second heating means which is an electrical immersion heater for heating the liquid metal, located in said inlet means or said outlet means, and adjacent the filter medium, said second heating means being arranged for immersion in liquid metal contained in the means in which said second heating means is located.

3. Ladle according to claim 1, wherein the filter medium is a filtering bed based on alumina gravel.

4. Ladle according to claim 1, wherein the second heating means comprises at least one immersion heater of diameter less than 40 mm.

5. Ladle according to claim 1, wherein the immersion heater has a diameter smaller than 30 mm.

6. Ladle according to claim 1, wherein the immersion heater has a heating portion dissipating at least 5 kW/m of length.

7. Ladle according to claim 1, wherein the second heating means is located in the inlet means.

8. Ladle according to claim 1, wherein the second heating means is located beneath the grid supporting the filter medium.

9. Ladle according to claim 1, wherein the ladle comprises a covering lid, and the first heating means comprises resistors located in the lid.

10. Ladle according to claim 1, wherein the inlet means comprises an entry for liquid metal to a lower portion of the filter medium, and the outlet means comprises an exit for liquid metal from the filter medium which is located above said entry.

11. Ladle according to claim 9, additionally comprising means for heating a stream of air by said resistors, and means for passing the heated stream of air through the filter bed.

* * * * *